US008784230B1

(12) United States Patent
Mitchell

(10) Patent No.: US 8,784,230 B1
(45) Date of Patent: Jul. 22, 2014

(54) SWING TRAINING DEVICE

(71) Applicant: Steven Mitchell, Fort Lauderdale, FL (US)

(72) Inventor: Steven Mitchell, Fort Lauderdale, FL (US)

( * ) Notice: Subject to any disclaimer, the term of this patent is extended or adjusted under 35 U.S.C. 154(b) by 0 days.

(21) Appl. No.: 13/940,451

(22) Filed: Jul. 12, 2013

Related U.S. Application Data

(60) Provisional application No. 61/670,706, filed on Jul. 12, 2012.

(51) Int. Cl.
*A63B 69/36* (2006.01)
*A63B 69/00* (2006.01)

(52) U.S. Cl.
CPC ..... *A63B 69/0057* (2013.01); *A63B 69/0002* (2013.01); *A63B 69/3667* (2013.01)
USPC ..... 473/271; 473/452

(58) Field of Classification Search
USPC ..... 473/215, 216, 217, 218, 219, 227, 266, 473/270, 271, 272, 273, 275, 277, 422
See application file for complete search history.

(56) References Cited

U.S. PATENT DOCUMENTS

| | | | | |
|---|---|---|---|---|
| 3,372,930 | A | 3/1968 | Sertich | |
| 3,466,040 | A | 9/1969 | Sertich | |
| 4,194,735 | A | 3/1980 | Wilson | |
| 4,225,133 | A | 9/1980 | Kiray | |
| 4,593,909 | A * | 6/1986 | Anselmo et al. | 473/216 |
| 4,657,258 | A * | 4/1987 | Melov et al. | 473/272 |
| 5,810,673 | A | 9/1998 | Castleberry | |
| 6,224,522 | B1 | 5/2001 | Ervin | |
| 6,638,176 | B1 | 10/2003 | Hayes et al. | |
| 6,988,966 | B1 | 1/2006 | Guzman | |
| 7,090,599 | B2 * | 8/2006 | Hedgepath | 473/452 |
| 7,125,350 | B1 * | 10/2006 | Reason-Kerkhoff | 473/452 |
| 7,335,117 | B2 * | 2/2008 | Reason-Kerkhoff | 473/452 |
| 7,468,010 | B2 | 12/2008 | Du Brock | |
| 7,494,453 | B2 * | 2/2009 | Wehrell | 482/124 |
| 7,775,914 | B1 | 8/2010 | Greene | |
| 2006/0046864 | A1 * | 3/2006 | Pagano | 473/270 |
| 2006/0234816 | A1 * | 10/2006 | Reason-Kerkhoff | 473/452 |
| 2006/0258486 | A1 | 11/2006 | Hedgepath | |
| 2010/0267498 | A1 | 10/2010 | Bard | |
| 2011/0098137 | A1 | 4/2011 | Golom | |

* cited by examiner

*Primary Examiner* — Nini Legesse
(74) *Attorney, Agent, or Firm* — Christopher & Weisberg, P.A.

(57) ABSTRACT

A baseball, softball and golf swing training device having a base platform, an adjustable and movable forward foot stop and an adjustable belt adjustably connected to a pair of straps for controlling the hips and may also include a pivot foot pedal for pivoting a hitter's rear foot with a heel lifting wedge, at least one adjustable pedal stopper for limiting the amount of pivot wherein the foot pedal pivots when swinging. The amount of rotation is dictated by a pair adjustable pedal stoppers and the adjustable forward foot stop dictates the distance a hitter steps forward into a pitch with the lead foot and the angle of the lead foot when stepping into a pitch. With respect to golf, the forward foot stop dictates the placement and angle of the forward foot when hitting a golf ball.

20 Claims, 11 Drawing Sheets

SWING TRAINING DEVICE

CROSS REFERENCE TO RELATED APPLICATIONS

This application claims the benefit of provisional patent application Ser. No. 61/670,706 filed Jul. 12, 2012.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention This invention relates generally to a portable baseball, softball and golf swing training device, and more particularly, to a portable baseball. Softball and golf swing training device that allows, fixes and controls the amount of pivoting of the rear foot and the distance and angle of the forward foot when stepping into a pitch or hitting a golf ball in a manner that is fixed for each swing while being adjustable to an individual batter's or golfer's swing style.

2. Description of the Background Art

Baseball and softball players and golfers are always looking for ways to improve their swing and power. Improving a player's batting or swing form and technique is based on repetition and creating muscle memory. Baseball and softball hitters swing with the pivoting of the rear foot and stepping into a pitch with the forward foot. It is well known, that to realize the most power and momentum in a batting swing a hitter creates torque in the hips by pivoting the rear foot, rotating the hips and stepping into a pitch with the forward foot. Hitting a golf ball is different in that the forward foot is kept stationary and the rear loot pivoted when swinging. It is also important that a hitter keep the hips level and avoid lifting upward when hitting. Each player has a different comfort level with the amount a rear foot needs to be rotated and the distance and angle of the forward foot when stepping into a pitch or its position when hitting a golf ball.

A variety of baseball batting and golf swing training devices for practicing the swings are known in the background art. However, these known devices tend to only focus on the pivoting of the rear foot or placement of the feet. For instance, U.S. Pat. No. 7,775,914, issued to Greene, discloses a baseball swing training apparatus having an elongate base and static forward stop, step member, connecting member and pivot step member extending laterally from the connecting member. U.S. Pat. No. 7,468,010, issued to Du Brock, discloses an apparatus having a base and stride limiter defining a stride area for training a batter to hit a baseball with proper swing mechanics by controlling swing stride. U.S. Pat. No. 7,009,559, issued to Hedgepath, discloses a baseball batting stance training assembly having a mat and plurality of removable foot-receiving cuffs. U.S. Pat. No. 6,988,966, issued to Guzman, discloses a method for controlling a batter's foot comprising a flexible panel having an arch and secured to the ground with a pair of rods. U.S. Pat. No. 6,638,176, issued to Hayes et al., discloses a sports stance follow-through training apparatus having a planar foot platform, a flexible foot guard and a ground spike pivotally connected to the bottom of the platform. U.S. Pat. No. 5,810,671, issued to Castleberry, discloses a golf swing training apparatus having a base and rotator disk attached to the base for receiving a user's foot. U.S. Pat. No. 4,194,735 issued to Wilson, discloses a batting practice trainer apparatus comprising two oppositely disposed flat support members having a home plate member disposed therebetween and attached thereto, and placement guide members comprised of pliable material and having a pivot foot recess, a first stride foot recess and a second stride foot recess. U.S. Pat. No. 3,372,930, issued to Sertich, discloses a rotatable foot support, foot strap and foot guide. U.S. Pub. No. 2011/0098137, tiled by Golom, discloses a baseball swing training device including a rear fool pivot limiting mechanism having a rotating dement and rotating limiting element. U.S. Pub. No. 2010/0267498, filed by Bard, discloses a sports training aid having a placement area inclined in two directions. U.S. Pub. No. 2006/0258486, tiled by Hedgepath, discloses a baseball batting stance training mat and assembly comprising a stance training mat and at least one rearward foot receiving cuff. Although these references disclose various swing training devices, they fail to adequately address or resolve the shortcomings in the field of proper swing training.

The aforementioned devices do not provide a device or system that facilitates training the required repetition in the pivoting of the rear foot, stepping into a pitch with the forward foot (or placement of the forward foot in golf) and keeping the hips level with consistency and simultaneously when swinging. As each of these aspects of proper hitting techniques are needed to improve and excel in hitting a baseball, a training device that focuses on all these techniques is needed to help a batter improve and excel in hitting techniques. However, there are no known batting training devices that provide this complete level and technique of training. Therefore, there exists a need for such a baseball or golf swing training device that addresses and resolves these issues. It is, therefore, to the effective resolution of the aforementioned problems and shortcomings of the prior art that the present invention is directed. The instant invention addresses this unfulfilled need in the prior art by providing a baseball or golf swing training device as contemplated by the instant invention disclosed herein.

BRIEF SUMMARY OF THE INVENTION

In light of the foregoing, it is an object of the present invention to provide a baseball softball and golf swing training device, generally referenced as a swing training device that improves a player's swing mechanics.

In light of the foregoing, it is an object of the present invention to provide a swing training device that improves a player's swing power.

It is also an object of the instant invention to provide swing training device that teaches muscle memory in the rear foot pivoting by limiting rotational movement of the rear foot and elevation of the heel.

It is another object of the instant invention to provide a swing training device that can teach muscle memory in the forward loot stepping by controlling the distance and angle of the forward foot step in accordance with a player's personal style and preference.

It is an additional object of the instant invention to provide a swing training device that teaches muscle memory in the hips by limiting the amount of lift in the hips when swinging. it is a further object of the instant invention to provide a swing training device that is adjustable to a player's height and hitting style so that it can be used by multiple players.

It is yet another object of the instant invention to provide a swing training device adaptable to baseball, softball and golf.

It is yet a further object of the instant invention to provide a swing training device that is cost effective to manufacture.

In light of these and other objects, the instant invention comprises a swing training device, especially for baseball and softball, that simultaneously exercises and teaches muscle memory with respect to the rear foot pivoting and heel lift, forward foot movement and angle when stepping into a pitch (or placement for golf) and hip level when swinging. The swing training device is also adapted for training proper swinging technique in golf. Each of these aspects of swing training device are adjustable to a hitter's or golfer's comfort level and size by creating predictable repetition while preventing poor techniques and tendencies through repetition. The swing training device comprises a base platform, a pivot foot pedal for pivoting a hitter's rear foot and having a heel wedge, at least one adjustable pedal stopper for limiting the amount of pivot, an adjustable and movable forward foot stop and an adjustable belt adjustably connected to a pair of straps to prevent the hips from lifting too high when swinging. The foot pedal includes the mounted heel wedge, which may be adjustable, to lift a hitter's heel and adjust its height based on a hitter's comfort level. The foot pedal pivots when swinging to facilitate the creation of torque up through the legs and into the hips. The amount the pedal rotates is preferably dictated and controlled by a pair adjustable pedal stoppers. The adjustable forward foot stop dictates the distance a hitter steps forward into a pitch with the lead foot and the angle of the lead foot when stepping into a pitch. With respect to golf, the forward foot stop dictates the placement and angle of the forward foot when hitting a golf ball. The angle of the foot stop is adjustable to dictate the angle of a hitter's forward or lead foot when hitting a ball in accordance with comfort level. The base may be foldable along a hinge line with hinges, not shown, for storage and preferably includes a handle for carrying and transporting the baseball hitting training device. The instant invention may also include a carrying case with an opening in the top for the handle. With respect to golf, the instant invention may include a removable tee on the base.

In accordance with these and other objects, which will become apparent hereinafter, the instant invention will now be described with particular reference to the accompanying drawings.

DETAILED DESCRIPTION OF THE INVENTION

With reference to the drawings, FIGS. 1 to 11 depict the preferred and alternative embodiments of the instant invention which is generally referenced as a swing training device, swing training device and, or by numeric character 10 for die preferred embodiment and numeric character 100 for the alternative embodiment. The instant invention 10 comprises a swing training device for training baseball, softball and golf players proper swing techniques and form to improve hitting performance and power through muscle memory techniques. The swing training device 10 simultaneously exercises the rear foot pivoting and heel lift, forward foot movement and angle when stepping into a pitch (or placement for golf) and hip level when swinging a bat or club. Each of these aspects of the instant invention 10, are adjustable to a hitter's or golfer's comfort level and size and creates predictable repetition while preventing poor techniques and tendencies through muscle memory. The instant invention 10, 100 may be designed for both right and left handed hitters.

Figure 1:
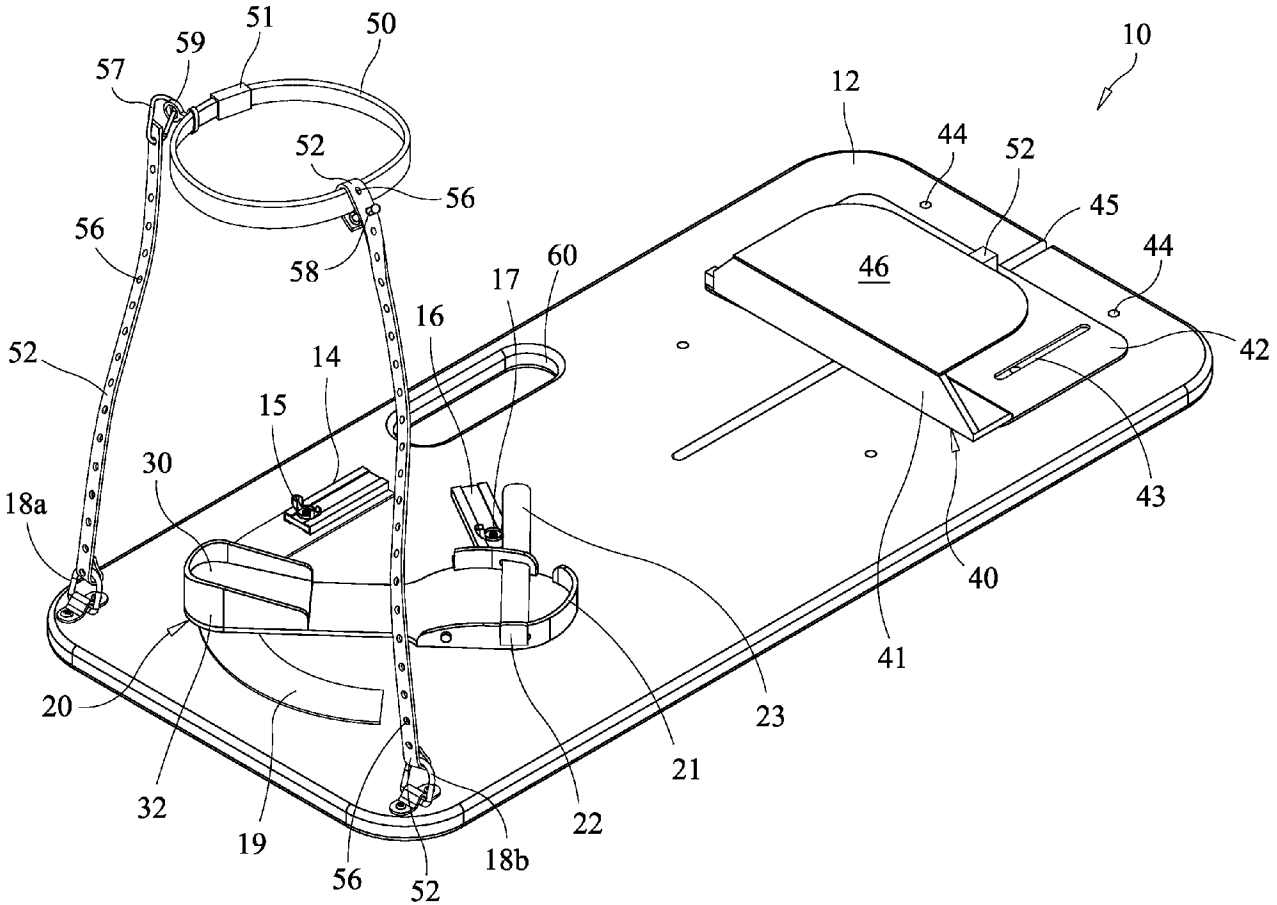
FIG. 1 is a perspective view of the swing training device, in accordance with the preferred embodiment of the instant invention.
Figure 2:
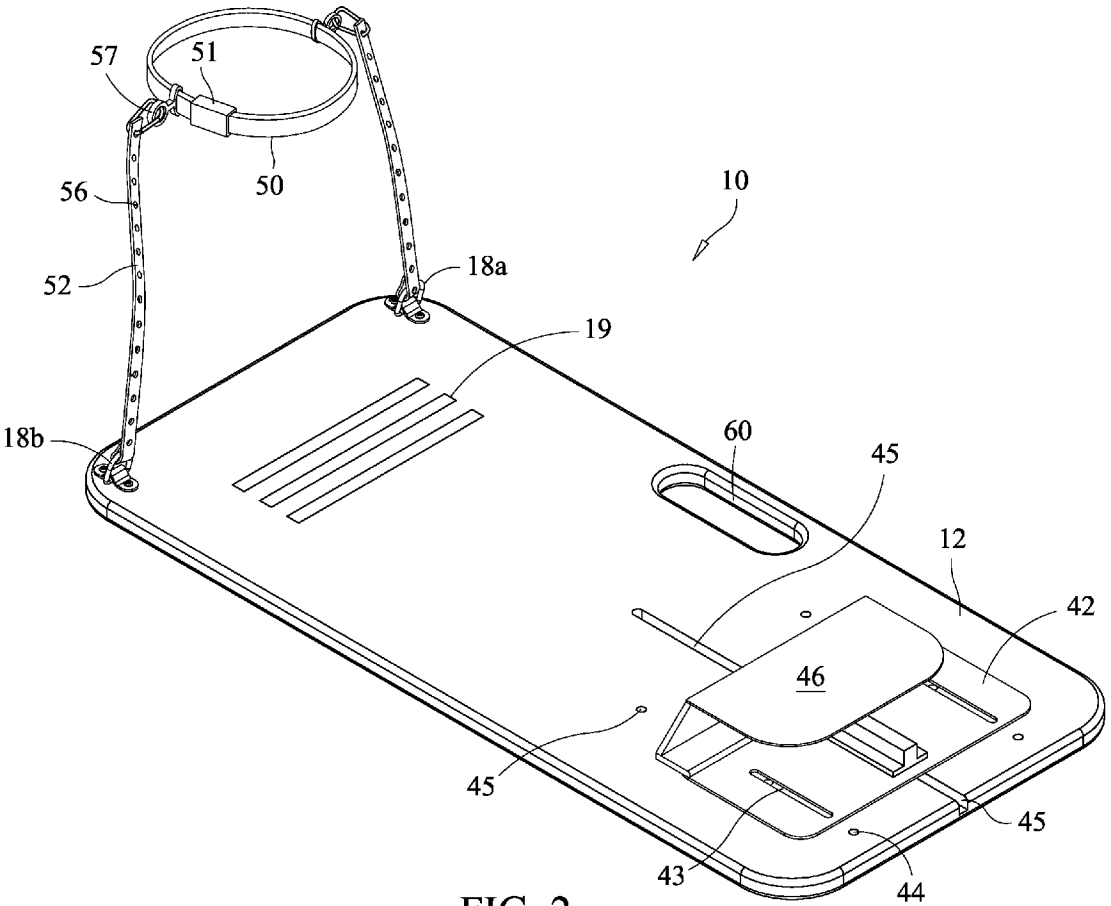
FIG. 2 is a perspective view of the swing training device without a rear foot pedal, in accordance with the preferred embodiment of the instant invention.
Figure 3:
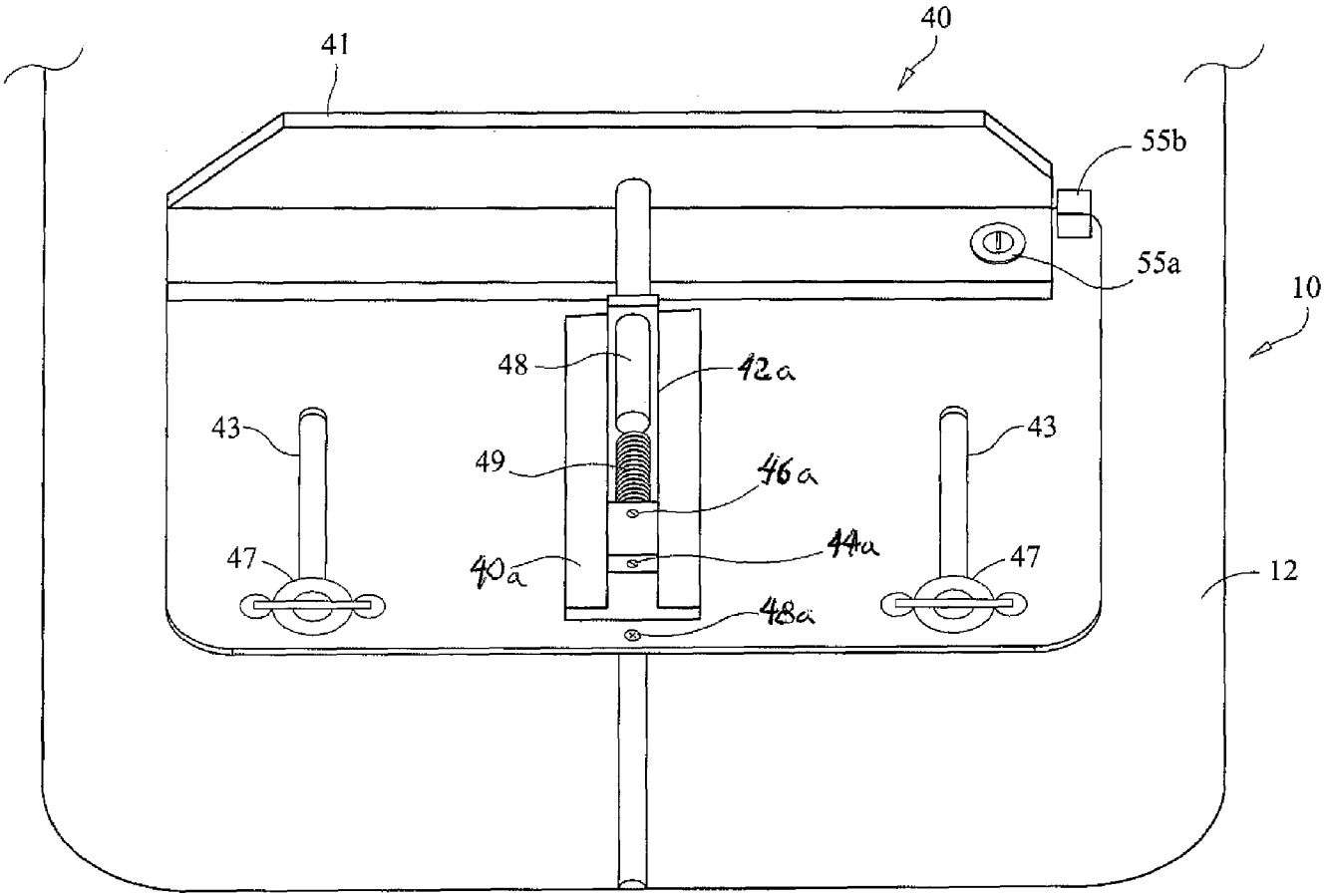
FIG. 3 is a perspective view of the articulating forward foot stop of the swing training device, in accordance with the preferred embodiment of the instant invention.
Figure 4:
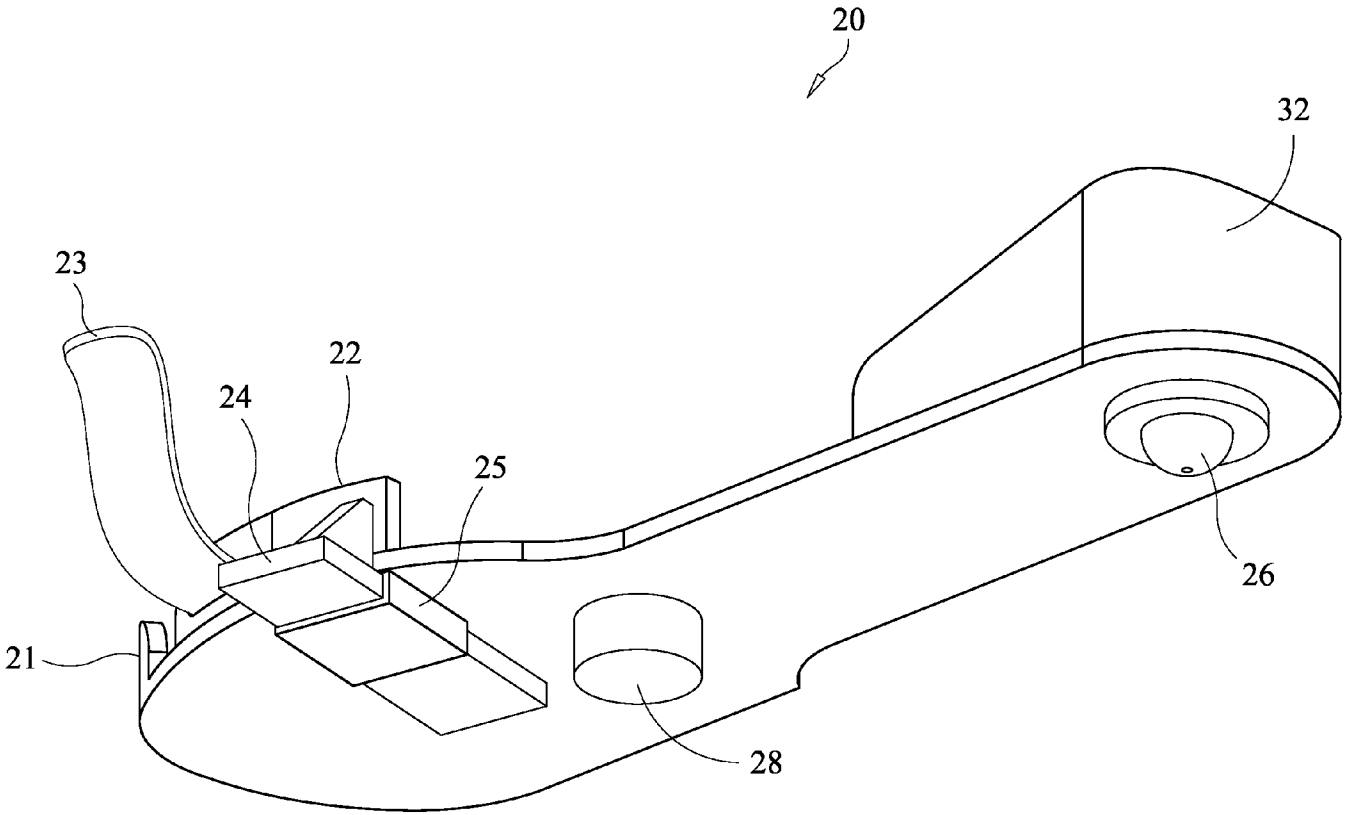
FIG. 4 is a perspective view of the pivoting rear foot pedal of the swing training device, in accordance with the preferred embodiment of the instant invention.
Figure 8:
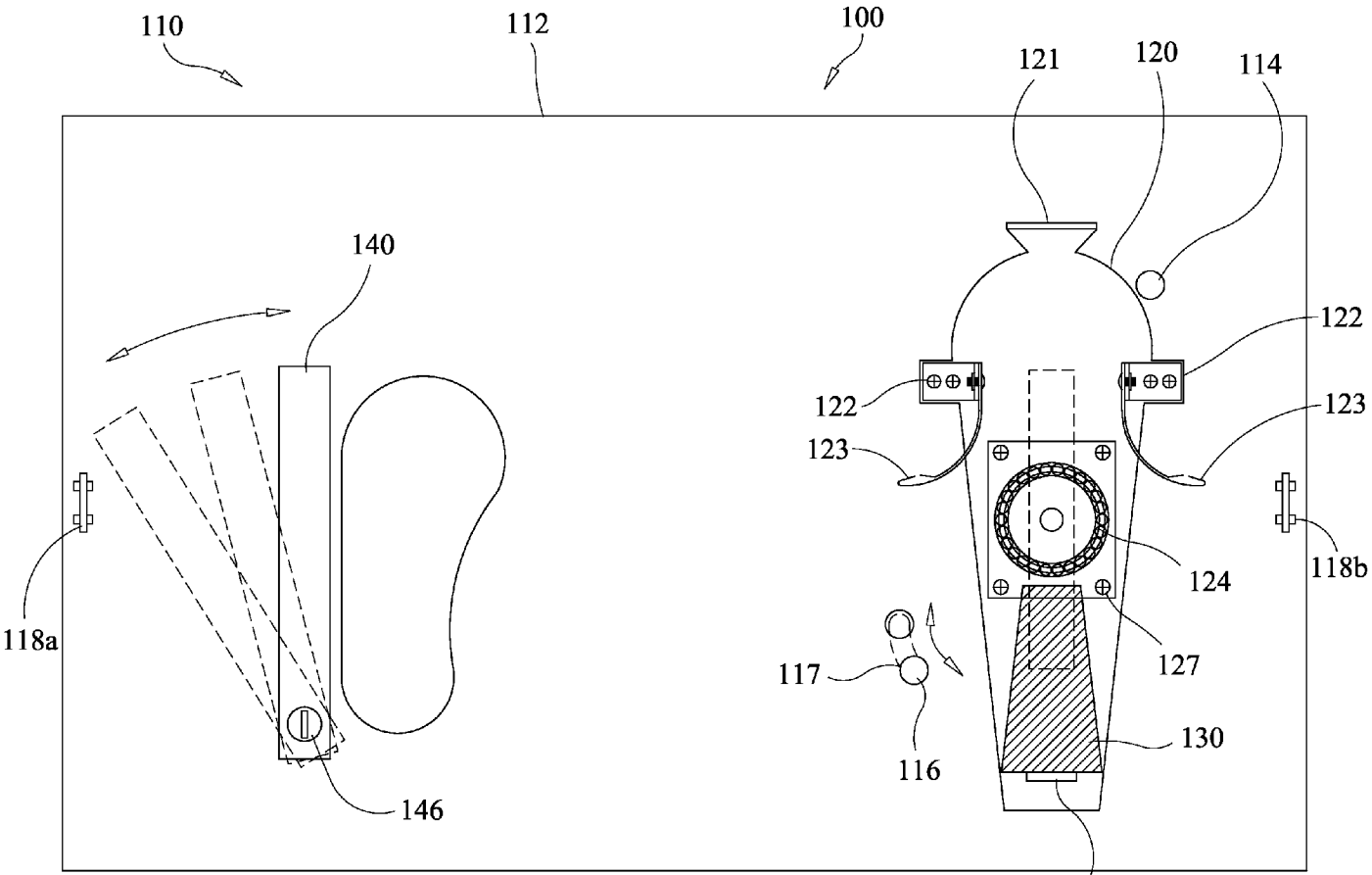
FIG. 8 is a plan view of the swing training device, in accordance with the alternative embodiment of the instant invention.
Figure 10:
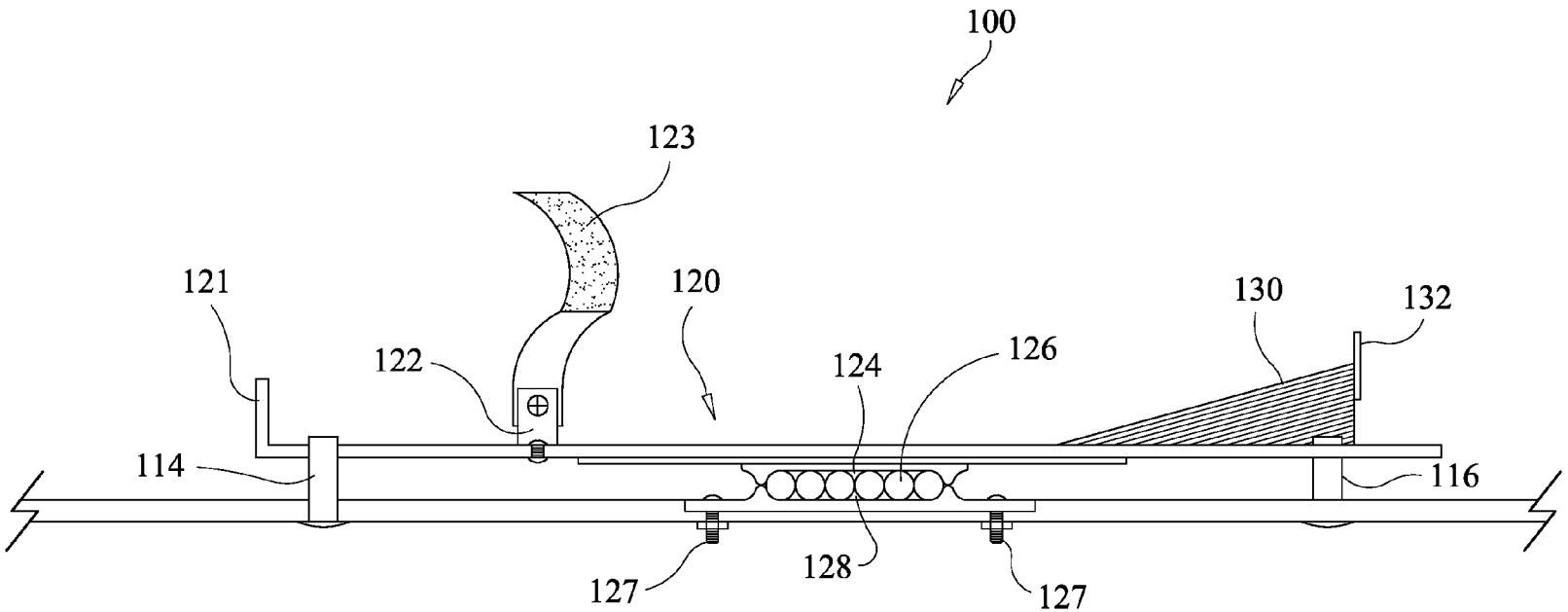
FIG. 10 is a side elevational view of the rear foot pedal and wedge of the swing training device, in accordance with the alternative embodiment of the instant invention.
Figure 11:
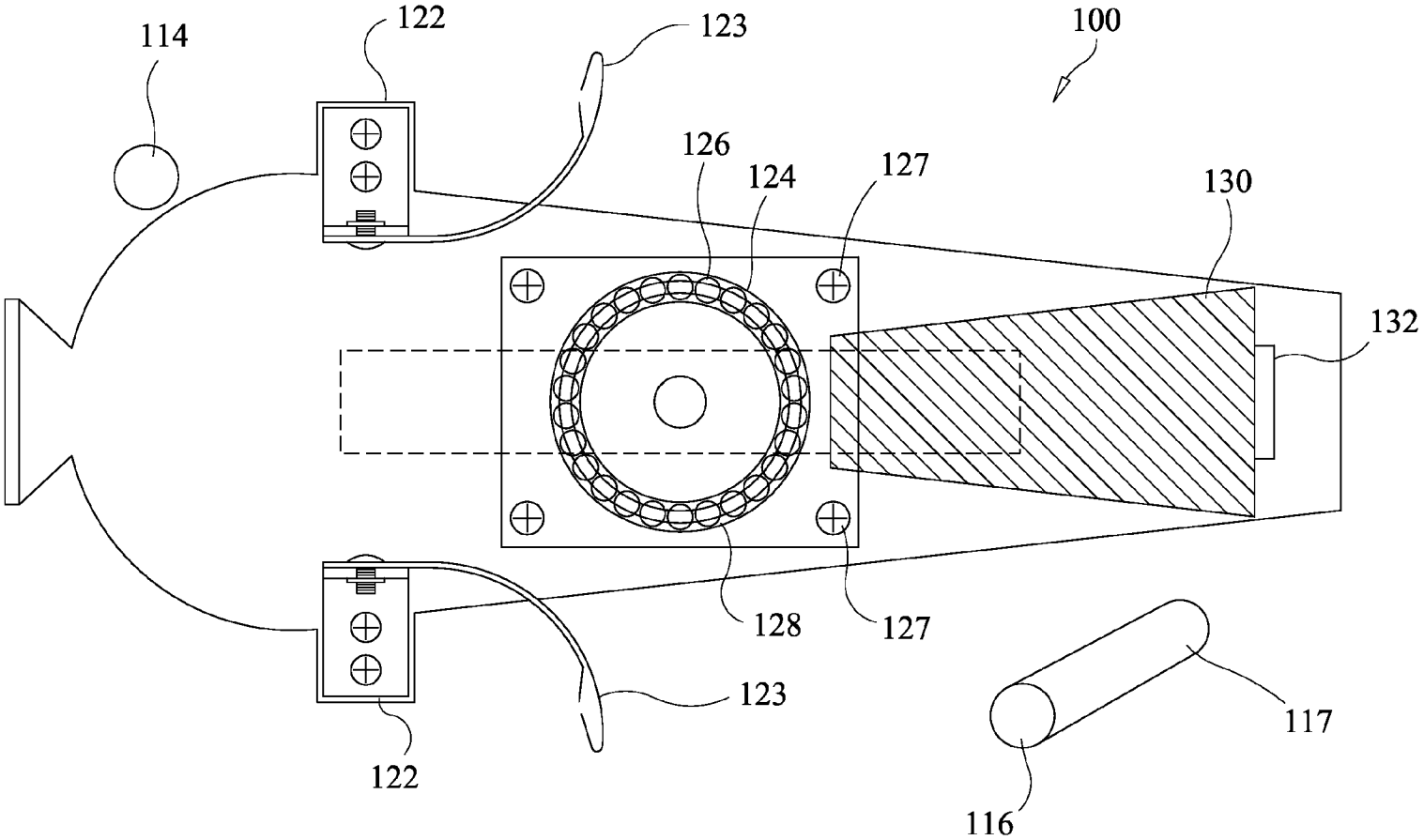
FIG. 11 is plan view of the rear foot pedal and wedge of the swing training device, in accordance with she alternative embodiment of the instant invention.

With reference to FIGS. 1-4, the first preferred embodiment of the swing training device 10 comprises a base platform 12, a pivoting rear loot pedal 20 for a batter's rear foot, a forward foot adjustable and articulating stop 40 and an adjustable heel pedal stopper 14 and an adjustable toe-end pedal stopper 16, as shown in FIG 1. The rear foot pedal 20 may also comprise an adjustable or non-adjustable heel lift 30. The first preferred embodiment 10 trains a hitter to consistently pivot their rear foot a desired distance or arc while lifting his or her heel when swinging a bat or club. With reference to FIG. 4, the foot pedal 20 comprises a heel pivot knob 26 and foot support guide 28 depending from the bottom surface of the foot pedal 20, a heel guard 32, an adjustable forward foot end guard 22 to accommodate various foot widths that is adjusted by slide member 24 and sleeve 25, a toe-end guard 21 at the from of the pedal 20 and an adjustable strap 23. The hitter's rear foot is secured in the pedal 20 by one or more straps 23. The heel pivot knob 26 and, or foot support knob 28 may comprise a rotation mechanism 124 having a plurality of ball bearings 126 rotatably secured in a retention ring 128, as shown in FIGS. 8, 10 and 11. The rotation mechanism 124 allows the pedal 20 to freely rotate with minimal friction. The heal pivot knob 26 glides along an arcuate plate 19, which is secured to the top of the base platform 12. The amount of angular pivoting the foot pedal 20 allows is determined by the positioning of the heel pedal stopper 14 and toe-end pedal stopper 16. The pedal stoppers

14, 16 slide into position and are secured to prevent movement by tightening fasteners 15 and 16 respectively, such as wing nuts or bolts.

With reference to FIGS. 1-3, the second preferred embodiment of the swing training device 10 comprises a base platform 12, a forward foot adjustable and articulating stop 40, generally referenced as a forward foot stop 40, and friction strips 19 proximal the rear end of the base and an adjustable heel pedal stopper 14 and an adjustable toe-end pedal stopper 16. The forward foot adjustable and articulating stop 40 comprises a stop base 42, a front lip or plate 41, a safety plate 46, adjustment slots 43, adjustment fasteners 47, spring-loaded articulating mechanism 40*a*, pivot rod or bolt 55*a* and pivot stop 55*b*. The stop base 42, front lip 41 and safety plate 46 preferably comprise a single machined piece, plastic piece or components welded together. The spring-loaded articulating mechanism 50 comprises a spring assembly base 42*a* that comprises an elongated U-shaped or enclosed channel 42*a* that supports and contains an articulating bolt 48, spring 49, biasing block 44*a* and one or more spring tension adjustment screws 64*a*, 48*a*. The tension in the spring 49 is adjusted to increase or decrease resistance, respectively, by moving the block 44*a* forward or backward and securing it by tightening the screw(s) 46*a* and, or 48*a*. The placement of the forward foot stop 40 is adjustable in accordance with a hitter's preference for the amount he or she likes to step into a pitch. The forward foot stop 40 is adjusted by loosening the adjustment fasteners 47, sliding the forward foot stop assembly 40 along the fasteners 47 in the slots 43 into the desired position and tightening the fasteners 47 once in place. The fasteners 47 may screw into threaded apertures in the base 12 coinciding with the slot 43. The forward foot stop 40 pivots about the pivot rod 55*a* until it hits the pivot stop 55*b*. When a hitter steps into a pitch their forward foot engages the front plate 41 causing it to pivot and press forward causing the spring 49 to coil inward until the pivot stop 55*b* is hit.

Figure 7:
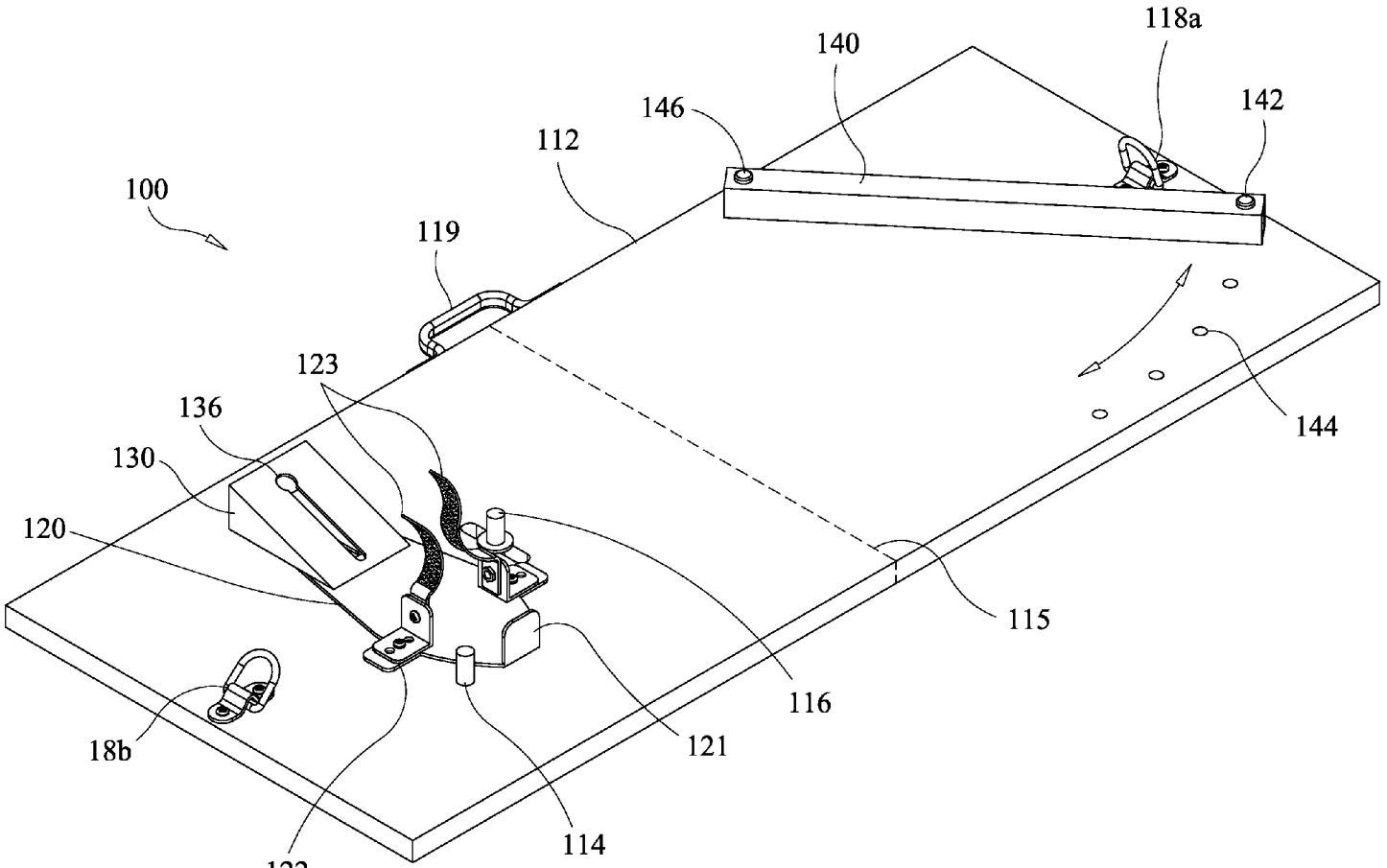
FIG. 7 is a perspective view of the swing training device, in accordance with the alternative embodiment of the instant invention.

The first and second preferred embodiment 10 may also comprise a handle 60. They may also comprise a centrally located hinge 115, as shown in FIG. 7, for folding the swing training device. The instant invention 10, 100 is preferably manufactured from a plastic or plastic-like material to facilitate mass production.

The instant invention 10 may also comprise a belt 50 and restraint straps 52 secured to the belt 50 to prevent the hips from lifting when swinging. The restraint straps 52 are connected to a front restraint fastener 18*a* and rear restraint fastener 18*b*, respectively. The belt 50 includes an adjustment buckle 51. The restraint straps 52 comprise a plurality of apertures 56 for adjusting the straps 52 to a player's height. The strap fasteners 52 may have a pin or post 58 at one end that snaps into a desired aperture 56. Alternatively, the straps 52 may be secured to the belt by a C-clip 57 that mounts through an aperture 56 and a belt ring 59 attached to the belt 50 for facilitating the latching of the C-clip 57.

Figure 9:
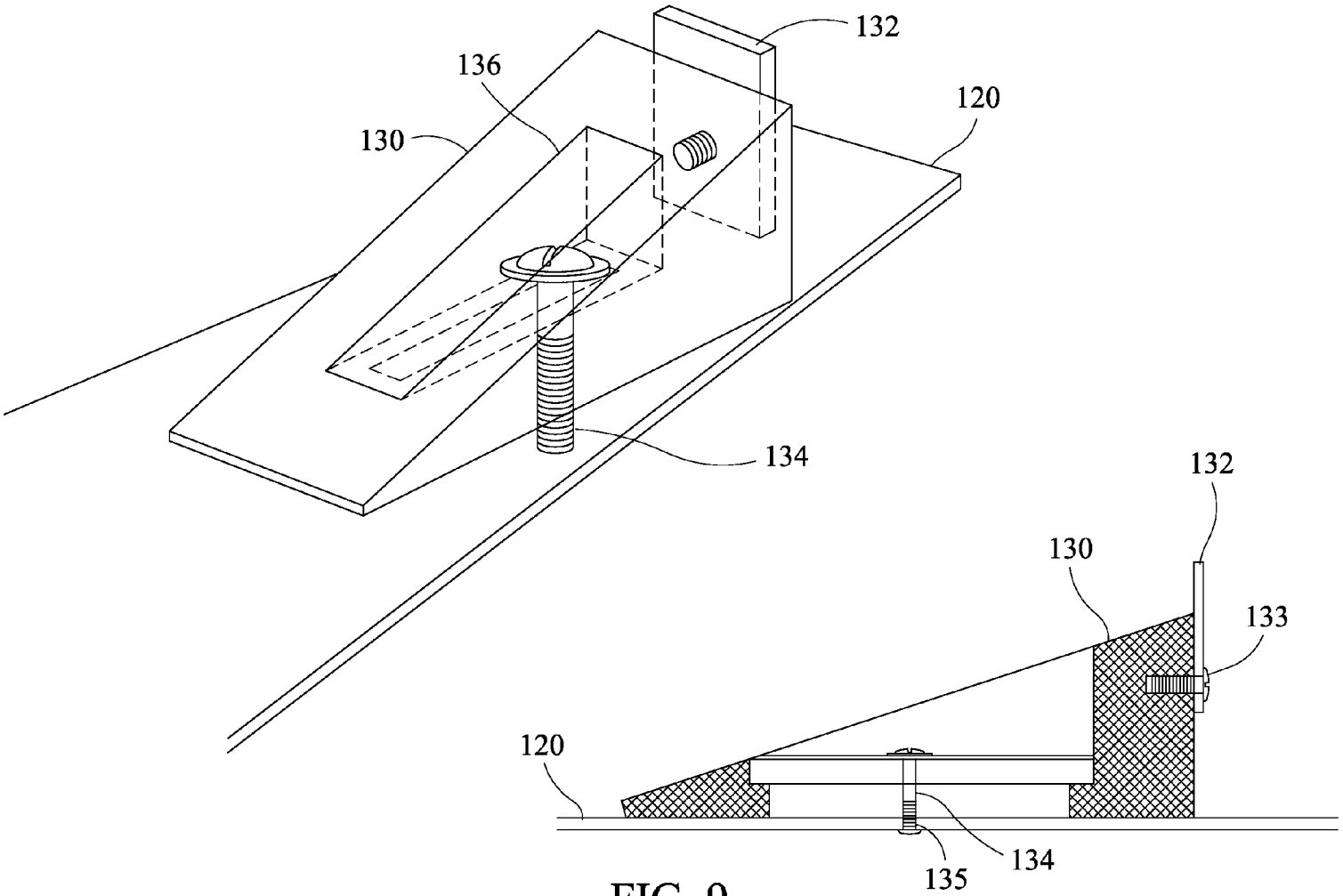
FIG. 9 shows a perspective view and side elevational view of the rear foot pedal and wedge of the swing training device, in accordance with the alternative embodiment of the instant invention.

With reference to FIGS. 4 and 9, the heel lift 30 may be adjustable to adjust the height of a hitter's heel. The adjustable heel lift 30 or 130 comprises a slot 136, adjustment screw or bolt 134 that passes through the slot 136 and into an aperture 135 in the foot pedal 20 or 120.

The base 12 supports the foot pedal 20, foot stop 40, front and rear restraint fasteners 18*a*, 18*b* and outside and inside pedal stoppers 14, 16. The foot pedal 20 may include the mounted and adjustable heel wedge 30 to lift a hitter's heel and adjust its height based on a hitter's comfort level. The foot pedal 20 pivots when a batter is swinging to facilitate the creation of torque up through the legs and into the hips. The amount the pedal 20 rotates is dictated by the pedal stoppers 14, 16. The position of the pedal stoppers 14, 16 is selected and secured by fasteners 15, 17 to dictate the minimum and maximum distances the pedal 20 rotates. The adjustable foot stop 40 dictates the distance a hitter steps forward into a pitch with the lead foot and the angle of the lead foot when stepping into a pitch or for placement and angle of the forward foot when hitting a golf ball. The angle of the foot stop 40 is adjustable to dictate the angle of a hitter's or golfer's lead foot by sliding the forward foot stop along tracks 43. The base 12 may include a central track 45 for guiding the forward foot slop 40 during adjustment when receiving a depending bolt or pin from the foot stop 40. The instant invention 10 may also include a carrying case with an opening in the top for the handle. With respect to golf, the instant invention 10 may include a removable tee on the base 12.

Figure 5:
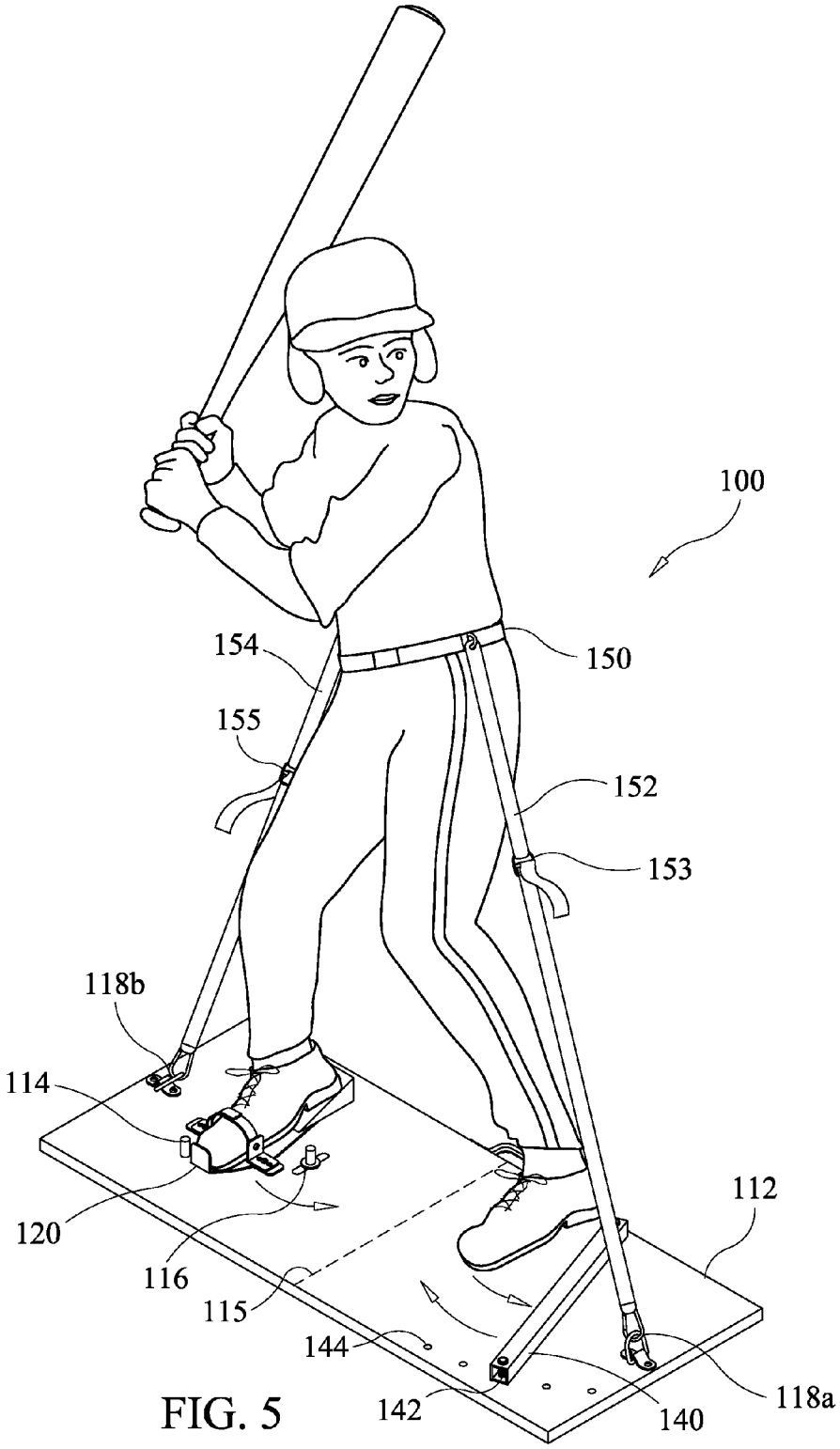
FIG. 5 is a perspective view of the swing training device as used, in accordance with an alternative embodiment of the instant invention.

Referring to FIG. 5, the details of the heel wedge 30 are shown. With reference to FIG. 5, the heel wedge 30 comprises a heel stop 32, heel wedge securing bolt 33, wedge securing boll 34, threaded wedge bolt insert 35 and wedge adjustment slot 36. The height of the heel stop 32 is adjusted by loosening and lightening the heel stop bolt 33. The wedge 30 is adjusted by loosening the heel wedge bolt 34, sliding the wedge forwards or backwards along the slot 36 and then tightening the wedge bolt 34. The desired height of the heel is raised by sliding the wedge 30 forward and lowered by sliding it backwards. The wedge bolt 34 resides in the slot 36 so as to be free from the heel for comfort to the hitter or golfer and threadably engages the wedge bolt insert 35. The bolt insert 35 is secured in or defined by the pedal 20.

Figure 6:
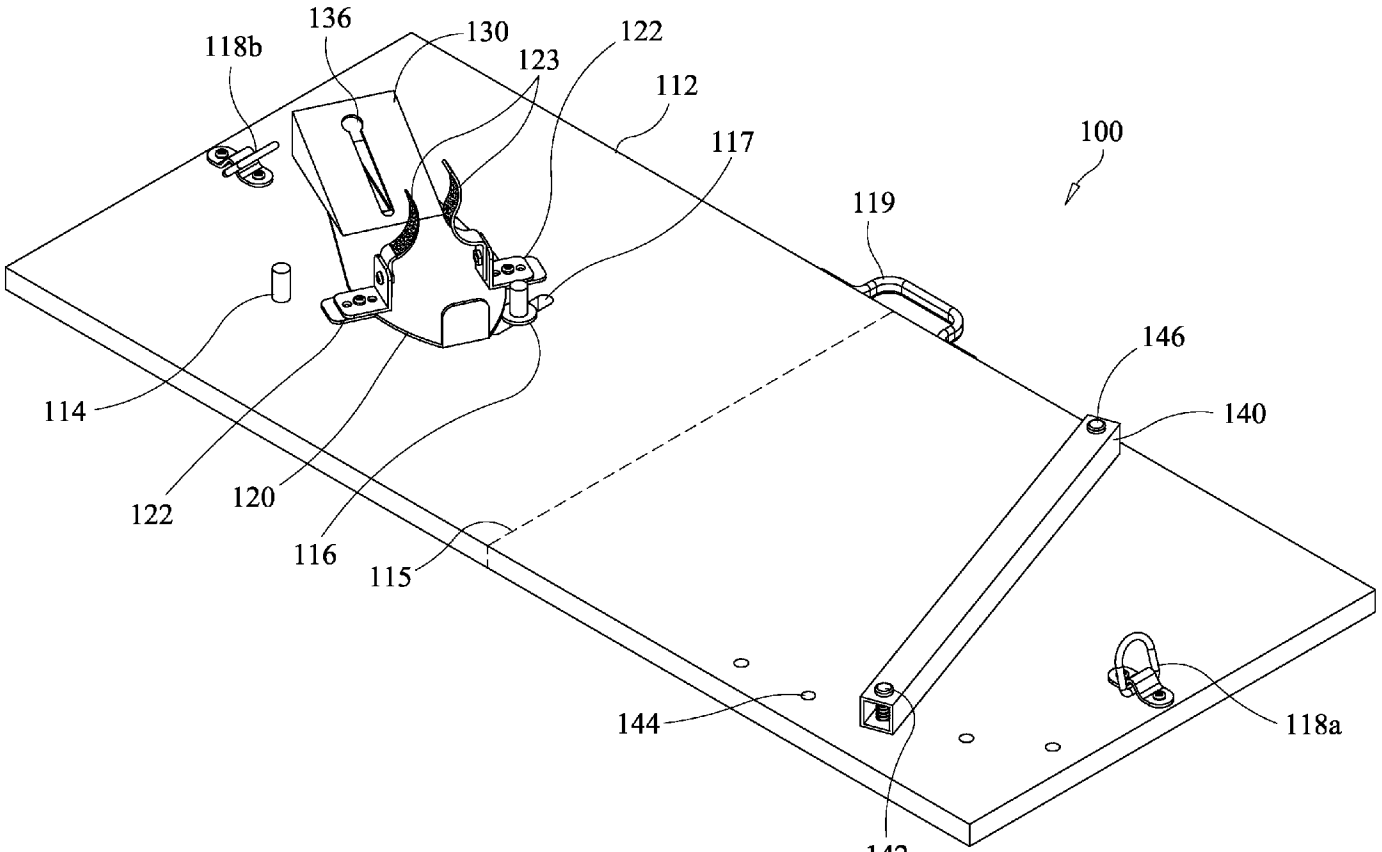
FIG. 6 is a perspective view of the swing training device in accordance with the alternative embodiment of the instant invention.

With reference to FIGS. 6 and 7, the foot pedal 20 includes a toe stop 21, shoe width adjustment brackets 22 and shoe straps 23. The shoe width adjustment brackets 22 can be moved inward and outward by loosening corresponding bolts threaded to the pedal 20 to accommodate the width of the hitter's rear foot. Once proper distance between the brackets 22 is achieved, the corresponding bolts are tightened. The straps 23 preferably comprise nylon with hook-arid-loop fasteners (Velcro®) for connecting the straps together around the shoe. Alternative fastening devices, such as buckles or snaps, may be used on the straps 23. In another embodiment, the pedal 20 may include a single elastic strap 23. Still referring to FIGS. 6 and 7, the foot pedal 20 is rotatably connected to a rotation mechanism 24 which is mounted to the base 12 with two or more bolts 27. The rotation mechanism 24 comprises a plurality of ball bearings 26 rotatably secured in a retention ring 28. The rotation mechanism 24 allows the pedal 20 to freely rotate with minimal friction.

With reference to FIGS. 5-11, in an alternative embodiment of the instant invention the swing training device 100 comprises a base 112, a rotational foot pedal 120 for a batter's rear foot, an adjustable forward foot stop 140 and an outside pedal stopper 114 and adjustable inside pedal stopper 116 for training, with repetition, a player's rear foot pivot and heel lift. The instant invention 100 may also comprise a belt 150 and a front restraint strap 152 and a rear restraint strap 154 connected to the belt 150 to prevent the hips from lifting when swinging, as shown in FIG. 1. The restraint straps 152, 154 are connected to a front restraint fastener 118*a* and rear restraint fastener 118*b*, respectively, and include adjustment buckles 153, 155, respectively, for adjusting the straps 152, 154 to a player's height. The base 112 supports the foot pedal 120, foot stop 140, front and rear restraint fasteners 118*a*, 118*b* and outside and inside pedal stoppers 114, 116. The foot pedal 120 includes a mounted and adjustable heel wedge 130 to lift a hitter's heel and adjust its height based on a hitter's comfort level. The foot pedal 120 pivots when a batter is swinging to facilitate the creation of torque up through the legs and into the hips. The amount the pedal 120 rotates is dictated by the pedal stoppers 114, 116 wherein the inside pedal stopper 116 is adjustable according to a hitter's preference. The inside pedal stopper 16 resides in a slot 117 and is securable in the slot 117 to fix the stopper 116 in a desired position. The length of the slot 117 is predetermined and limited lo dictate the minimum and maximum distances the pedal 120 rotates. The adjustable foot stop 140 dictates the distance a hitter steps forward into a pitch with the lead foot and the angle of the lead foot when stepping into a pitch or for placement and angle of the forward loot when hitting a golf ball. The angle of the foot stop 140 is adjustable to dictate the angle of a hitter's or golfers lead foot when hitting a ball in accordance with comfort level. The base 112 is foldable along a hinge line 15 with hinges, not shown, for storage and includes a handle 119 for carrying and transporting the baseball hitting training device 100. The instant invention 100 may also include a carrying case with an opening in the top for the handle. With respect to golf, the instant invention 100 may include a removable tee on the base 112.

Referring to FIGS. 5-9, the details of the heel wedge 130 are shown. With reference to FIG. 9, the heel wedge 130 comprises a heel stop 132, heel wedge securing bolt 133, wedge securing bolt 134. threaded wedge bolt insert 35 and wedge adjustment slot 136. The height of the heel stop 132 is adjusted by loosening and tightening the heel stop bolt 133. The wedge 130 is adjusted by loosening the heel wedge bolt 134, sliding the wedge forwards or backwards along the slot 36 and then tightening the wedge bolt 134. The desired height of the heel is raised by sliding the wedge 130 forward and lowered by sliding it backwards. The wedge bolt 34 resides in the slot 36 so as to be free from the heel for comfort to the hitter or golfer and threadably engages the wedge bolt insert 135. The bolt insert 135 is secured in or defined by the pedal 120.

With reference to FIGS. 10 and 11, the fool pedal 120 includes a toe stop 121, shoe width adjustment brackets 122 and shoe straps 123. The shoe width adjustment brackets 122 can be moved inward and outward by loosening corresponding bolts threaded to the pedal 120 to accommodate the width of the hitter's rear foot. Once proper distance between the brackets 122 is achieved, the corresponding bolts are tightened. The straps 123 preferably comprise nylon with hook-and-loop fasteners (Velcro®) for connecting the straps together around the shoe. Alternative fastening devices, such as buckles or snaps, may be used on the straps 123. In another embodiment, the pedal 20 may include a single elastic strap 123. Still referring to FIGS. 10 and 11, the foot pedal 120 is rotatably connected to a rotation mechanism 124 which is mounted to the base 112 with two or more bolts 127. The rotation mechanism 124 comprises a plurality of ball bearings 126 rotatably secured in a retention ring 128. The rotation mechanism 124 allows the pedal 120 to freely rotate with minimal friction.

The instant invention has been shown and described herein in what is considered to be the most practical and preferred embodiment. It is recognized, however, that departures may be made therefrom within the scope of the invention and that obvious structural and/or functional modifications will occur to a person skilled in the art.

That is claimed is:

1. A baseball, softball and golf swing training device, said device comprising:

a base platform;

a rear foot pedal;

an articulating forward foot stop adjustably mounted to said base platform, said foot stop having a pivot point at one end and being engaged with a spring assembly behind said foot stop for providing resistance to movement of said foot stop without locking said foot stop; and means for adjusting the position of said foot stop.

2. A device as recited in claim 1, wherein said means for adjusting the position of said foot stop comprises:

at least one slot defined in said foot stop, a fastener passing through said slot and a plurality of threaded apertures defined in said base coinciding with said slot.

3. A device as recited in claim 1, wherein said articulating forward foot stop further comprises:

a base;

a front plate projecting upward from said base; and a top plate projecting inward over said base from said front plate.

4. A device as recited in claim 1, wherein said spring assembly comprises:

an elongated channel;

a bolt in said channel;

a spring engaging at one end an end of said bolt; and a stop for securing an opposite end of said spring.

5. A device as recited in claim 4, wherein said spring assembly further comprises:

a screw means for adjusting the tension in said spring.

6. A device as recited in claim 1, wherein said rear foot pedal comprises:

a pivoting foot pedal, said foot pedal being pivotally secured to said base a predetermined distance from said forward foot stop; and at least one guide depending from said foot pedal, said guide comprising a ball bearing assembly in said guide.

7. A device as recited in claim 6, wherein said device further comprises:

an arcuate plate secured to said base for being slidably engaged by said depending guide.

8. A device as recited in claim 6, wherein said foot pedal comprises:

a foot strap;

an adjustable side plate for adjusting to the width of a foot; and heel lift.

9. A device as recited in claim 6, wherein said device further comprises:

means for adjusting the heel lift to adjust the height a heel is lifted.

10. A device as recited in claim 6, wherein said device further comprises:

at least one adjustable stop means secured on said base for dictating the distance said foot pedal rotates.

11. A device as recited in claim 1, wherein said device further comprises:

a belt adaptable for placement around a waist; and at least one adjustable strap for dictating the length said belt is raised, said adjustable strap having a means for adjusting the length of said strap at one end of said strap, said strap being secured to said base at an opposite end of said strap.

12. A device as recited in claim 11, wherein said means for adjusting the length of said strap comprises:

a plurality of apertures defined in said strap; and a post projecting from said strap for snapping into a selected one of said apertures.

13. A device as recited in claim 11, wherein said means for adjusting the length of said strap comprises:

a plurality of apertures defined in said strap; and a clip mounted to said strap and adapted for latching through a selected one of said apertures.

14. A device as recited in claim 1, wherein said device further comprises a handle for said base.

15. A baseball, softball and golf swing training device, said device comprising:

a base platform;

an articulating forward foot stop adjustably mounted to said base platform, said foot stop having a pivot point at one end and being engaged with a spring assembly behind said foot stop for providing resistance to movement of said foot stop without locking said foot stop;

a pivoting foot pedal, said foot pedal being pivotally secured to said base a predetermined distance from said forward foot stop; and at least one guide depending from said foot petal.

16. A device as recited in claim 15, wherein said articulating forward foot stop comprises:

a base;

a front plate projecting upward from said base; and a top plate projecting inward over said base from said front plate.

17. A device as recited in claim 16, wherein said spring assembly comprises:

an elongated channel;

a bolt in said channel;

a spring engaging at one end an end of said bolt; and a stop for securing an opposite end of said spring.

18. A device as recited in claim 15, wherein said device further comprises:

a belt adaptable for placement around a waist; and at least one adjustable strap for dictating the length said belt is raised, said adjustable strap having a means for adjusting the length of said strap at one end of said strap, said strap being secured to said base at an opposite end of said strap.

19. A device as recited in claim 18, wherein said means for adjusting the length of said strap comprises:

a plurality of apertures defined in said strap; and a post projecting from said strap for snapping into a selected one of said apertures.

20. A device as recited in claim 18, wherein said means for adjusting the length of said strap comprises:

a plurality of apertures defined in said strap; and a clip mounted to said strap and adapted for latching through a selected one of said apertures.

* * * * *